US009677845B2

(12) United States Patent
Cook, Jr. et al.

(10) Patent No.: US 9,677,845 B2
(45) Date of Patent: Jun. 13, 2017

(54) FIREARM HANDGUARD HAVING HEAT-REDUCING FEATURES

(71) Applicant: Lancer Systems L.P., Quakertown, PA (US)

(72) Inventors: Robert D. Cook, Jr., Collegeville, PA (US); Kasimere McManus, Quakertown, PA (US); Matthew Pettit, Breinigsville, PA (US)

(73) Assignee: Lancer Systems L.P., Quakertown, PA (US)

( * ) Notice: Subject to any disclaimer, the term of this patent is extended or adjusted under 35 U.S.C. 154(b) by 0 days.

(21) Appl. No.: 15/090,180

(22) Filed: Apr. 4, 2016

(65) Prior Publication Data

US 2016/0290761 A1 Oct. 6, 2016

Related U.S. Application Data

(60) Provisional application No. 62/142,208, filed on Apr. 2, 2015.

(51) Int. Cl.
*F41C 23/16* (2006.01)
*F41A 21/44* (2006.01)

(52) U.S. Cl.
CPC ..... *F41C 23/16* (2013.01); *F41A 21/44* (2013.01)

(58) Field of Classification Search
CPC ..... F41C 23/16; F41A 21/44
USPC ..... 42/71.01
See application file for complete search history.

(56) References Cited

U.S. PATENT DOCUMENTS

| | | | | |
|---|---|---|---|---|
| 2,965,994 | A * | 12/1960 | Sullivan | F41C 23/16 42/71.01 |
| 3,367,054 | A * | 2/1968 | Loffler | B29D 23/001 42/71.01 |
| 4,841,836 | A * | 6/1989 | Bundy | F41A 21/44 89/14.1 |
| 6,355,338 | B1 | 3/2002 | Hilmas et al. | |
| 6,838,162 | B1 | 1/2005 | Gruber et al. | |
| 6,889,464 | B2 | 5/2005 | Degerness | |
| 7,721,478 | B2 | 5/2010 | Withers et al. | |
| 8,161,753 | B2 | 4/2012 | Benoit et al. | |
| 8,336,243 | B2 | 12/2012 | Langevin et al. | |
| 8,347,773 | B2 * | 1/2013 | Schlenkert | F41A 13/12 89/14.1 |
| 8,448,367 | B2 | 5/2013 | Samson et al. | |
| 9,207,031 | B2 * | 12/2015 | Balthaser | F41A 21/44 |

(Continued)

FOREIGN PATENT DOCUMENTS

| | | | |
|---|---|---|---|
| CN | 104949581 | A | 9/2015 |
| CN | 103992115 | B | 10/2015 |
| WO | 9422780 | A1 | 10/1994 |

*Primary Examiner* — Reginald Tillman, Jr.
(74) *Attorney, Agent, or Firm* — Design IP

(57) ABSTRACT

A handguard comprising a plurality of layers of composite material. At least one of the layers is a ceramic matrix composite and at least one of the layers, and preferably the outer later, is a carbon fiber reinforced composite. In addition, the outermost layer is preferably a woven fabric carbon fiber reinforced composite. In one embodiment, one or more ceramic matrix composite layers is sandwiched between layers of carbon fiber reinforced composite. In another embodiment, an innermost layer is a ceramic matrix composite and the outermost layer is a carbon fiber reinforced composite.

16 Claims, 3 Drawing Sheets

(56) References Cited

U.S. PATENT DOCUMENTS

| | | | | |
|---|---|---|---|---|
| 2006/0207152 | A1* | 9/2006 | Lazor | F41C 23/16 42/71.01 |
| 2008/0143005 | A1 | 6/2008 | Lim et al. | |
| 2010/0162608 | A1 | 7/2010 | McCann | |
| 2011/0100204 | A1* | 5/2011 | Schlenkert | F41A 13/12 89/14.1 |
| 2011/0119981 | A1* | 5/2011 | Larue | F41C 23/16 42/71.01 |
| 2012/0180358 | A1* | 7/2012 | Samson | F41A 13/12 42/71.01 |
| 2013/0276342 | A1* | 10/2013 | Chvala | F41A 13/12 42/90 |
| 2014/0076135 | A1 | 3/2014 | Balthaser et al. | |
| 2014/0082990 | A1* | 3/2014 | Lee | F41A 21/24 42/96 |
| 2014/0305019 | A1* | 10/2014 | King, Jr. | F41C 23/18 42/71.01 |
| 2015/0369558 | A1* | 12/2015 | Gottzmann | F41C 23/18 42/71.01 |

* cited by examiner

FIREARM HANDGUARD HAVING HEAT-REDUCING FEATURES

FIELD OF THE INVENTION

The present invention relates to accessories for firearms, specifically to firearm handguards having improved heat-reduction features that protect a user from heat injuries during use of a firearm.

BACKGROUND OF THE INVENTION

During the use of a firearm, the barrel is heated by the combustion of the propellant used in each round of firearm ammunition. Handguards, which commonly include rail systems and other means for attaching accessories to the firearm, typically axially surround the barrel and include a foregrip area where the user typically holds the firearm forward of the magazine during operation. Heat that is dissipating from the barrel heats up the foregrip area of the handguard such that the temperature of the foregrip area may become unsafe for operator use.

Accordingly, there is a need for firearm handguards having improved heat-reduction capabilities.

BRIEF DESCRIPTION OF THE DRAWINGS

The foregoing summary, as well as the following detailed description of the invention, will be better understood when read in conjunction with the appended drawings. For the purpose of illustrating the invention disclosed herein, certain embodiments in accordance with the herein disclosed invention are shown in the drawings. It should be understood, however, that the herein disclosed invention is not limited to the precise arrangements shown. It should also be understood that, in the drawings, the parts are not necessarily drawn to scale. The present invention will hereinafter be described in conjunction with the appended drawing figures, wherein like numerals denote like elements. In the drawings.

DETAILED DESCRIPTION OF THE PREFERRED EMBODIMENTS

Figure 1:
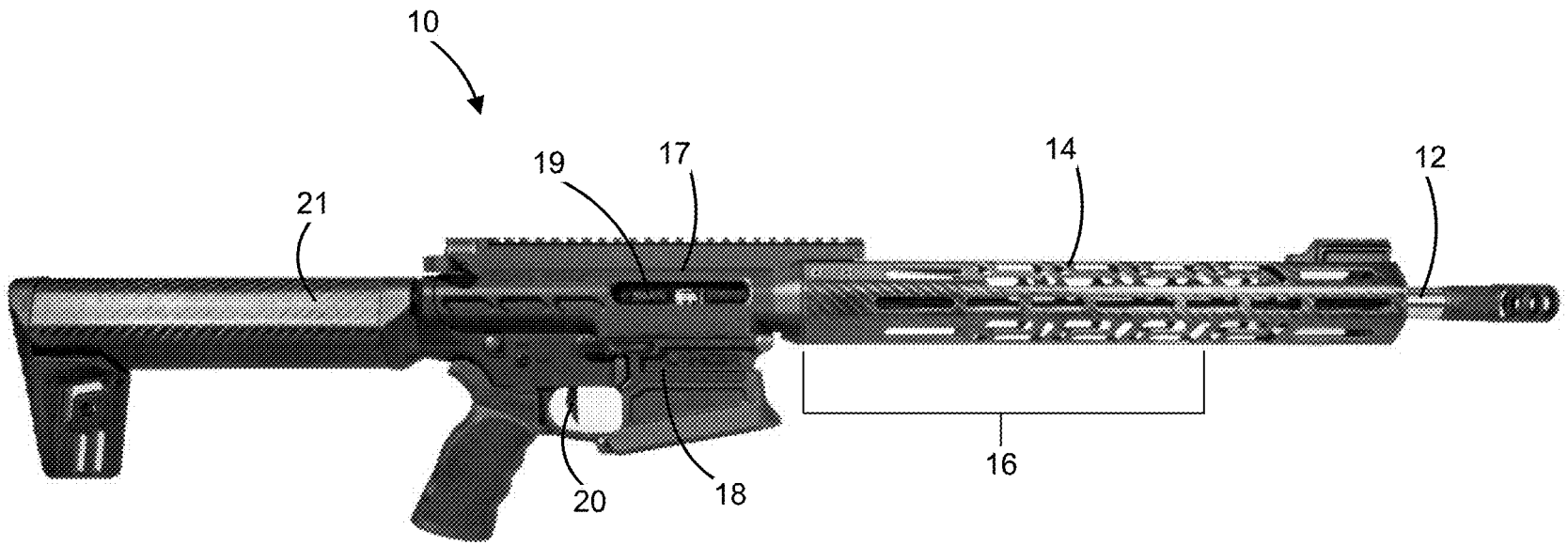
FIG. 1 PRIOR ART
FIG. 1 is a side view of a firearm showing an installed carbon fiber handguard according to the prior art.

The ensuing detailed description provides preferred exemplary embodiments only, and is not intended to limit the scope, applicability, or configuration of the herein disclosed inventions. Rather, the ensuing detailed description of the preferred exemplary embodiments will provide those skilled in the art with an enabling description for implementing the preferred exemplary embodiments in accordance with the herein disclosed invention. It should be understood that various changes may be made in the function and arrangement of elements without departing from the spirit and scope of the invention, as set forth in the appended claims.

To aid in describing the invention, directional terms may be used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

Referring now to the figures, FIG. 1 shows an exemplary firearm 10 having a barrel 12 and a handguard 14 comprised of carbon fiber in accordance with the prior art. As is conventional, the firearm 10 further comprises an upper receiver 17, a lower receiver 18, a bolt carrier group 19 located within the upper receiver 17, a trigger 20, and a butt stock 21 affixed to the butt end of the lower receiver 18. The handguard 14 is attached to the upper receiver 17 with a barrel nut (see barrel nut 122 in FIG. 2) to which the handguard 14 is removably attached.

Figure 2:
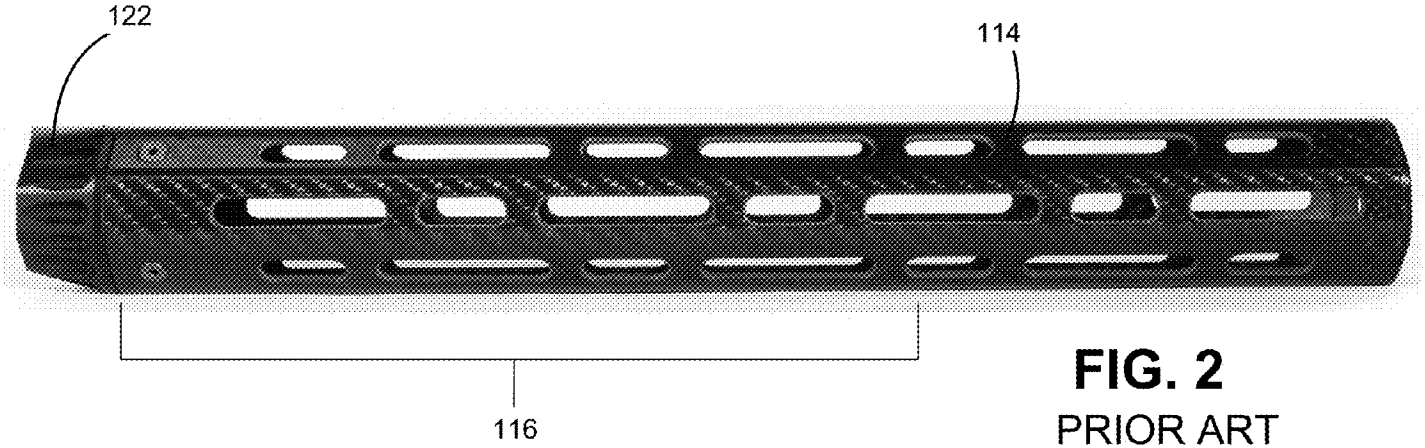
FIG. 2 PRIOR ART
FIGS. 2 and 3 are views of carbon fiber handguards according to the prior art.
Figure 3:
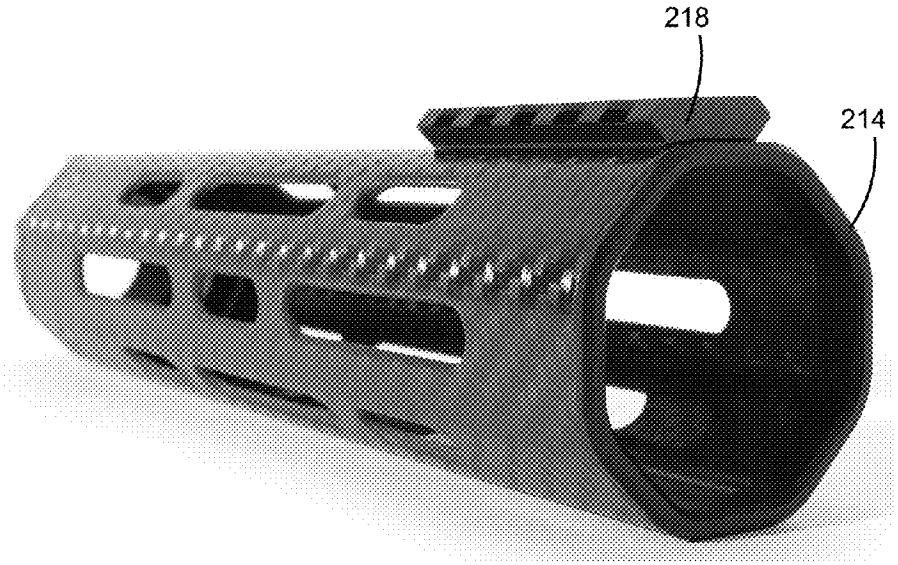
FIG. 3 PRIOR ART

The handguard 14 comprises a foregrip area 16 where a user of the firearm 10 would typically hold the firearm 10 during operation. It should be understood that the length and location of the foregrip area 16 shown in FIGS. 1 and 2 is exemplary only, and could comprise any portion or portions of the length or perimeter of the handguard depending on the preferences of the particular firearm user, as discussed in further detail below. FIGS. 2 and 3 are views of additional handguards 114, 214 comprised of carbon fiber in accordance with the prior art. Handguard 114 comprises an exemplary foregrip area 116 and handguard 214 comprises an optional rail 218 for attachment of an accessory, e.g. a sight or scope, to the firearm.

The prior art handguards 14,114,214 shown in FIGS. 1-3 are constructed of multiple layers of a carbon fiber-reinforced composite material (CFRP) having an epoxy matrix, with at least the innermost and outermost layers of the construction using a carbon fabric (i.e., a woven pattern) material and the intermediate layers typically using various unidirectional arrangements of carbon fibers.

Figure 4:
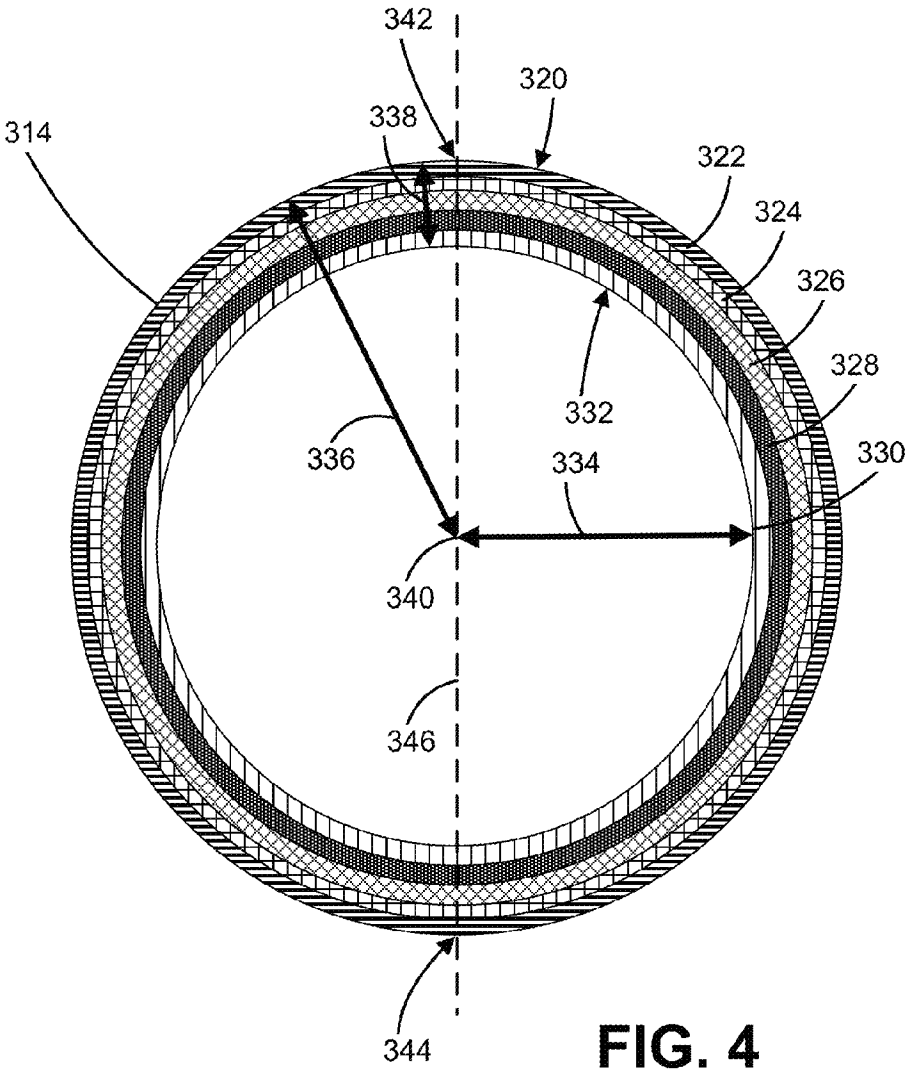
FIG. 4 is a cross-sectional view of a handguard construction according to embodiments of the present invention.

Referring now to FIG. 4, the present invention comprises various features for reducing the transfer of heat from the barrel of the firearm to the foregrip area of the handguard. FIG. 4 shows a cross-sectional view of an embodiment of a handguard 314 in accordance with the present invention. In this embodiment, the handguard 314 is comprised of an outermost layer 322, intermediate layers 324,326,328, and an innermost layer 330. An exterior surface of the outermost layer 322 corresponds with an exterior surface 320 of the handguard 314 and an interior surface of the innermost layer 330 corresponds with an interior surface 332 of the handguard 314. The handguard 314 has an outer radius 336 measured between a centerpoint 340 of the cross-sectional area of the handguard and the exterior surface 320 and an inner radius 334 measured between the centerpoint 340 and the interior surface 332. The difference between the lengths of the outer radius 336 and the inner radius 334 comprises a wall thickness 338 of the handguard 314. The handguard has a centerline 346 that passes through the center point 340 between an uppermost point 342 and a lowermost point 344 of the handguard 314.

The inventors have discovered that improved heat absorption and dissipation characteristics can result from including one or more layers of a ceramic material within a multi-layer layup that is then formed into a handguard.

In one embodiment of a handguard 314 according to the present invention, the innermost layer 330 is comprised of a ceramic-matrix composite (CMC) material, and the remaining layers 322,324,326,328 are comprised of standard CFRP. In this embodiment, a pyrolyzed piece of CMC is layered up and co-cured along with one or more layers of carbon fiber prepreg, and this layup is then constructed into the handguard 314. In some embodiments according to the present invention, the thickness of the innermost layer 330 is at least 5% of the wall thickness 338 of the handguard 314 but no more than 90% of the wall thickness 338. In alternate embodiments, the thickness of the innermost layer 330 is between 5-50% of the wall thickness 338 of the handguard 314, and more preferably between 10-25% of the wall thickness 338 of the handguard 314.

In an alternate embodiment, a CMC material is used for the layer 328 immediately adjacent to the innermost layer 330 of the handguard 314 and/or the next layer 326 moving towards the exterior surface 320 of the handguard 314, and a standard CFRP material is used for the innermost layer 330 and the outermost layer 322 of the layup of the handguard 314. In the alternative, a CMC material is used for all of the plurality of intermediate layers 324,326,328 of the layup and a standard CFRP material is used only for the innermost layer 330 and the outermost layer 322 of the layup. In these embodiments, a pyrolyzed piece of CMC is co-cured with and encapsulated by the carbon fiber prepreg, and the resulting layup is then formed into the handguard 314.

In yet another alternate embodiment, the handguard 314 could be cured using standard polymer composite prepreg, and then an insert piece comprised of CMC could be placed within the interior of the handguard 314 and mechanically fastened, glued, or affixed to the interior surface 332 and/or other portions of the handguard 314 in order to maintain the insert in place within the handguard 314. In one embodiment, the handguard 314 could be cured with one or more tabs or catches extending inwardly towards the centerpoint 340 from its innermost layer 330, and the insert could be formed with corresponding slots or grooves that fixedly engage the tabs or catches when the insert is inserted within the handguard 314. In alternate embodiments, the insert piece could be comprised of any other suitable low thermal-conductivity material.

Improved heat performance characteristics for the handguard 314 can also be achieved by using specific higher-temperature resins for the matrix. Suitable examples of higher-temperature resins include polyimide, Bis-Maleimides (BMI), and polyether ether ketone(PEEK). In one embodiment, a woven fabric of suitable insulating fibers (e.g., carbon fiber or glass fiber) could be formed with a BMI matrix into one or more layers of a layup. Once the BMI is cured and/or post-cured according to its material data sheet, the layup is then formed into the handguard 314 such that the innermost layer 330 (and optionally additional layers) of the handguard 314 is comprised of the fiber-reinforced BMI polymer matrix, with additional layers (up to and including the outermost layer 322) of the handguard 314 optionally comprises of a standard CFRP material, for example carbon fiber embedded in an epoxy matrix. Thus, this process creates a gradient composite consisting of polymer matrices and fiber layers comprised of different materials.

Improved heat performance characteristics for the handguard 314 can also be achieved by imparting some or all of the layers of the layup with a heat reflective filler that is imparted to the prepreg layers before forming the layup. The heat reflective filler would act to reflect heat from the firearm barrel away from the outermost layer 322 of the handguard 314. In one embodiment, one, some, or all of the intermediate layers 324,326,328 of the handguard 314 could be imparted with the reflective filler. Suitable fillers include micron-scale ceramics, zirconia, and alumina.

In this embodiment the cross-sectional profile of the handguard 314 is circular for ease of illustration, but it should be understood that in alternate embodiments the cross-sectional profile of the handguard 314 could be any number of suitable shapes, for example octagonal (as in the prior art handguards 14,114,214 of FIGS. 1-3), hexagonal, or other suitable polygonal shapes. In the embodiment shown in FIG. 4, the handguard 314 is comprised of five layers 322,324,326,328,330. In alternate embodiments according to the present invention, the handguard could be comprised of any number of layers based on, for example, the firearm for which it is to be used, weight requirements, and the specific heat-reduction performance that the user desires to achieve. In FIG. 4, the various layers 322,324,326,328,330 of the handguard 314 are each illustrated with a unique style of cross-hatching solely to demarcate the boundaries between the layers, not to indicate that each of the layers 322,324,326,328,330 is necessarily composed of a unique material or that reinforcing fibers (if any) located within each of said layers 322,324,326,328,330 are oriented or arranged in any specific direction or pattern.

As noted above, the foregrip area 16 of the firearm may comprise any portion or portions of the length of the handguard 314, up to and including the entire length of the handguard 314. The foregrip area 16 may also comprise any segment or sector of the cross-sectional area of the handguard as illustrated in FIG. 4. For example, in some embodiments the foregrip area 16 may comprise that portion of the handguard 314 falling within a sector of the cross-sectional area of the handguard 314 that originates at the centerpoint 340, bisects the centerline 346, and includes the lowermost point 344 of the handguard 314 therein. In some embodiments the sector may comprise an angle of 180 degrees measured from the centerpoint 340, such that the foregrip area 16 comprises the entire bottom half of the handguard 314. In alternate embodiments, the sector may comprise an angle of 120 degrees measured from the centerpoint 340, such that the foregrip area 16 comprises that portion of the handguard 314 extending 60 degrees in both directions from the centerline 346, centered about the lowermost point 344 of the handguard 314. In further alternate embodiments, the foregrip area 16 need not be in a regular shape and could be greater or different in size on the right or left side of the handguard 314 than on the opposing side. Many other sizes and arrangements of the foregrip area 16 are possible within the scope of this invention, as would be appreciated by one having ordinary skill in the art.

It is desirable that the foregrip area 16 of the firearm 10 not reach temperatures greater than 300 degrees F. so that users can safely handle the foregrip area 16 of the firearm while using insulated gloves. The concepts described herein are aimed at reducing the transfer of heat from the barrel 12 to the handguard 314 such that the foregrip area 16 of the handguard is maintained at a temperature no greater than 300 degrees F.

It should be appreciated that the foregoing is presented by way of illustration only, and not by way of any limitation, and that various alternatives and modifications may be made to the illustrated embodiments without departing from the spirit and scope of the present invention.

The invention claimed is:

1. A handguard for a firearm having a barrel nut, the handguard comprising:

a body comprising a plurality of layers of composite material, a fore end, a butt end, the butt end being adapted to be removably-secured to the barrel nut, the plurality of layers of composite material comprising an outer layer, an inner layer, and at least one intermediate layer, each of the at least one intermediate layer being sandwiched between the outer layer and the inner layer, wherein the inner layer comprises a ceramic matrix composite layer, the outer layer comprises a carbon-reinforced composite layer.

2. The handguard of claim 1, wherein the at least one intermediate layer comprises a carbon-reinforced composite layer.

3. The handguard of claim 1, wherein the outer layer, inner layer and the ceramic matrix composite layer being arranged so that no portion of the ceramic matrix composite layer is exposed to the external surface of the body.

4. The handguard of claim 1, wherein each of the at least one intermediate layer comprises a ceramic matrix composite layer.

5. The handguard of claim 1, wherein the outer and at least one intermediate layers each comprise a carbon-reinforced composite layer comprised of a woven carbon fiber fabric.

6. The handguard of claim 5, wherein at least one of the intermediate layers comprises a carbon-reinforced composite layer having at least one selected from the group of: unidirectional carbon fibers and randomly-arranged, chopped carbon fibers.

7. The handguard of claim 1, wherein the handguard has an upper portion and lower portion and the ceramic matrix composite layer is located only in the lower portion.

8. The handguard of claim 7, wherein the body includes a lowermost point and a centerline, the lower portion including the lowermost point and extending at least 60 degrees in each direction from the centerline.

9. The handguard of claim 1, wherein the body has a body thickness and each of the plurality of layers comprising a ceramic matrix composite has a layer thickness, and the sum of the layer thicknesses equals between 10 and 25% of the body thickness.

10. The handguard of claim 7, further comprising:

an accessory rail mounted to the upper portion of the handguard.

11. The handguard of claim 1, wherein at least one of the plurality of layers comprises a heat-reflective filler.

12. The handguard of claim 11, wherein the heat-reflective filler comprises at least one selected from the group of: a micron-scale ceramic, zirconia and aluminia.

13. The handguard of claim 1, wherein each of the least one of the plurality of layers comprises a resin, the resin of at least one of the plurality of layers comprising a high-temperature resin.

14. The handguard of claim 13, wherein the high-temperature resin is selected from the group of: polyimide, a bis-maleimide, and polyether ether ketone.

15. The handguard of claim 13, wherein the inner layer comprises a high-temperature resin.

16. The handguard of claim 1, wherein the body includes a plurality of openings formed therein.

* * * * *